US005862701A

United States Patent [19]

Bishop et al.

[11] Patent Number: 5,862,701

[45] Date of Patent: Jan. 26, 1999

[54] APPARATUS FOR MANUFACTURING STEERING RACK BARS

[75] Inventors: Arthur Ernest Bishop, Greenwich; Lyle John McLean, Marsfield, both of Australia

[73] Assignee: A.E. Bishop & Associates Pty. Limited, North Ryde, Australia

[21] Appl. No.: 652,466

[22] PCT Filed: Dec. 16, 1994

[86] PCT No.: PCT/AU94/00775

§ 371 Date: Jun. 17, 1996

§ 102(e) Date: Jun. 17, 1996

[87] PCT Pub. No.: WO95/16529

PCT Pub. Date: Jun. 22, 1995

[30] Foreign Application Priority Data

Dec. 16, 1993 [AU] Australia ..... PM 3026

[51] Int. Cl.[6] ..... B21D 22/00; B21J 9/18

[52] U.S. Cl. ..... 72/353.2; 72/453.01; 72/453.18

[58] Field of Search ..... 72/353.2, 306, 72/316, 394, 399, 403, 453.01, 453.02, 453.08–453.18, 297–312, 314, 309, 317, 319

[56] References Cited

U.S. PATENT DOCUMENTS 2,153,839 4/1939 Liebergeld ..... 72/316
3,916,667 11/1975 Paknke et al. ..... 72/403
4,571,982 2/1986 Bishop et al. ..... 72/400
4,715,210 12/1987 Bishop et al. ..... 72/400

FOREIGN PATENT DOCUMENTS

B 15579/83 1/1984 Australia .

*Primary Examiner*—Lowell A. Larson
*Assistant Examiner*—Rodney Butler
*Attorney, Agent, or Firm*—Nikaido, Marmelstein, Murray & Oram LLP

[57] ABSTRACT

A forging die for forming a steering rack portion having teeth and two longitudinally extending guide faces from a blank. The die comprising first (18) and second (19) die members and four forming elements (52, 53, 54, 55) to converge on the blank. The first forming element (52) being on the second die member (19) for forming the teeth, the second (53) and third (54) forming elements being on the first die member (18) for forming the guide faces. The fourth forming element (55) slidable relative to the first die member (18) for forming a surface of the portion and connected to a first bias means (83, 84) allowing movement of the fourth forming element (55) during forging. The die having opposed first and second grippers holding the blank during forging, the first gripper (23) connected to a second bias means (25, 36) and slidable relative to said first die member (18) and the second gripper (24) connected to a third bias means (26, 28) and slidable relative to said second die member (19), with the first bias means mechanically separated from the second bias means.

9 Claims, 7 Drawing Sheets

APPARATUS FOR MANUFACTURING STEERING RACK BARS

TECHNICAL FIELD

This invention relates to steering rack bars for automobiles and their manufacture.

BACKGROUND ART

The majority of steering rack bars are manufactured from a cylindrical bar of steel having cut therein teeth over about one quarter of the length extending from one end. The shortcomings of racks produced by this technique are described in U.S. Pat. Nos. 4,715,210 and 4,571,982 which describe a method and apparatus respectively for making steering rack bars by forging in a multi-element die commonly known as a "Y-Die" in which the forming elements of the die converge towards the centre line of the rack bar in order to maximise the forming pressure and produce minimal "flash". It is particularly suited to producing racks having a unique cross section through the toothed portion of the rack bar which resembles the capital letter "Y", which has significant advantages as described in U.S. Pat. No. 4,116,085.

Rack bars produced by the apparatus described in U.S. Pat. No. 4,571,982 have superior bending and fatigue strength to rack bars made from the same diameter cylindrical bar stock and the forging process permits either constant or variable ratio tooth forms, as described in U.S. Pat. No. 3,753,378, to be imparted. Variable ratio tooth forms, wherein the ratio curve changes smoothly over the axial extent of the rack travel, can not be accurately produced by broaching or grinding and can not be economically produced by methods other than forging, eg: chemical or electro discharge machining.

Rack bars have been produced by the "warm" forging technique described in U.S. Pat. No. 4,571,982 since 1983. A feature of that die is that the die cavity volume is closely matched to the volume of the blank so that minimal "flash" is produced. Although the claimed benefits of superior fatigue and bending strengths about principal axes, superior straightness of product, lower cost production and ability to produce variable ratio tooth forms have all been realised, production experience has highlighted a number of shortcomings in the design of the current form of Y-die.

Principal amongst the shortcomings of the current Y-die is the inability to independently control the forging and gripping loads. In this prior art die, the upper die element (controlling forging load) and upper gripper (controlling gripping load) are each attached to a single plate and pre-loaded vertically downwards by two springs. This plate is vertically slideable in the upper platen and hence independent motion of the upper die element and upper gripper is impossible. The upper die element serves to volumetrically contain the formed metal rising in the stem of the Y-form cross section of the rack and has been found in practice to rise to a varying (but slight) degree in order to accommodate the diametral tolerance of the blank. This results in the plate, to which the upper die element and upper gripper are attached, also rising to a varying degree and therefore producing variability in the gripping loads.

Moreover the uneven load distribution on the plate causes the side of the plate adjacent to the toothed portion of the rack to deflect vertically upward relative to the side supporting the upper gripper, tending to prise the upper and lower grippers open. This leads to a loss of gripping force and permits metal to be extruded axially between the grippers with attendant local loss of die pressure and consequent poor tooth fill. The upward relative deflection of the plate further unbalances the axial pressure distribution in the die cavity, often necessitating a number of iterations on the dimensions of the upper die element until satisfactory tooth fill and Y-form cross-section have been achieved. This process, which must be carried out after each change of tooling, can be time consuming and is consequently not suitable for a high volume production environment where rapid changeover of tooling is required.

A further consequence of the uneven deflection of the abovementioned plate is a lack of straightness in forged rack bars, which manifests as a bend at the transition between the toothed and cylindrical portions of rack bars.

A further shortcoming of the current design of Y-die is in the use of mechanical springs to control forging and gripping forces. The helical coil springs, as illustrated in U.S. Pat. No. 4,571,982, are difficult to package and for this reason mechanical beam springs have been used to date in production of Y-dies. However the abovementioned spring pre-load is not readily varied in such mechanical springs, whether of coil or beam type, and varies in service due to wear, thereby introducing variability to the process and, by loss of mechanical pre-load, increasing the likelihood of a fatigue failure in the springs. Also, different sizes of rack bars may require different maximum spring loads and/or spring rates and these parameters are again not readily varied in a production environment.

The present invention provides a die suited to the forming of steel rack bars of the configuration described in U.S. Pat. No. 4,571,982 without the shortcomings of the prior art of Y-die. An important feature of the present invention is the provision of separate control of gripping and forging forces and pressures. This separation of gripping and forging functions permits optimisation of each with attendant improvement of product tooth fill and rack bar straightness. Furthermore the return of the upper die element and the upper and lower grippers from the positions occupied at the moment of full die closure may be independently controlled and timed so as to release the forged rack from contact with the other die elements in a manner which avoids significant distortion and misalignment. Also the invention makes possible rapid fine tuning or re-establishment of forging parameters without having to dismantle the die, thereby facilitating rapid changeover of tooling and making the die suitable for use in a high volume production environment.

DISCLOSURE OF INVENTION

In one aspect the present invention is a die for forming a toothed portion of a steering rack bar from a blank by forging, the toothed portion having a face with teeth and at least two longitudinally extending guide faces, the die comprising first and second die members and a group of first, second, third and fourth forming elements relatively moveable to converge on the blank when placed in the die, the first forming element being part of the second die member and having a form on one face corresponding to the obverse form of the teeth, the second and third forming elements being part of the first die member and having forming faces adapted to form the longitudinally extending guide faces of the toothed portion, the fourth forming element connected to a first bias means and slideable relative to the first die member between the second and third forming elements and adapted to form a surface of the toothed portion lying between the guide faces and opposite the teeth, the first bias means allowing movement of the fourth forming element away from the blank under loads imposed during forging, the die further comprising a gripper system for longitudinally constraining the blank during forging, the gripper system comprising opposed first and second grippers loaded radially against a non-formed surface of the blank during forging, the first gripper connected to a second bias means and slideable relative to the first die member and the second gripper connected to a third bias means and slideable relative to the second die member, characterised in that the first bias means is mechanically separated from the second bias means.

Preferably the first, second and third bias means are hydraulic actuators. It is also preferable that the third and second bias means are hydraulically interconnected. It is of course possible that in an alternative form the third bias means may be a mechanical spring, in which case no hydraulic connection with the second bias means is necessary.

Preferably the magnitude of and instant of application of the pressure in at least one hydraulic actuator is separately controlled. It is also preferable that any one or more of the hydraulic actuators is controlled as a function of the relative displacement of the first and second die members.

Preferably at least one of the hydraulic actuators is controlled by at least one pressure relief valve. It is also preferable to have an accumulator connected to the hydraulic connection between at least one hydraulic actuator and its respective relief valve.

Preferably the die further comprises a restraint means for longitudinally restraining the blank during forging which is pivotally mounted about an axis substantially perpendicular to the blank. The restraint means having a face substantially perpendicular to the longitudinal axis of the blank and clamped by a clamp means against a fixed stop portion of the second die member during closure of the die.

In another aspect the present invention is a die for forming a toothed portion of a steering rack bar from a blank by forging, the toothed portion having a face with teeth and at least two longitudinally extending guide faces, the die comprising first and second die members and a group of first, second, third and fourth forming elements relatively moveable to converge on the blank when placed in the die, the first forming element being part of the second die member and having a form on one face corresponding to the obverse form of the teeth, the second and third forming elements being part of the first die member and having faces adapted to form the longitudinally extending guide faces of the toothed portion, and the fourth forming element connected to a first hydraulic actuator and slideable relative to the first die member between the second and third forming elements and adapted to form a surface of the toothed portion lying between the guide faces and opposite the teeth, the first hydraulic actuator allowing movement of the fourth forming element away from the blank under loads imposed during forging, characterised in that the magnitude and the instant of application of pressure in the first hydraulic actuator is controlled.

BRIEF DESCRIPTION OF THE DRAWINGS

In order that the invention may be better understood and put into practice an embodiment thereof is hereafter described by way of a non-limiting example, with reference to the accompanying drawings in which.

BEST MODE FOR CARRYING OUT INVENTION

Figure 1:
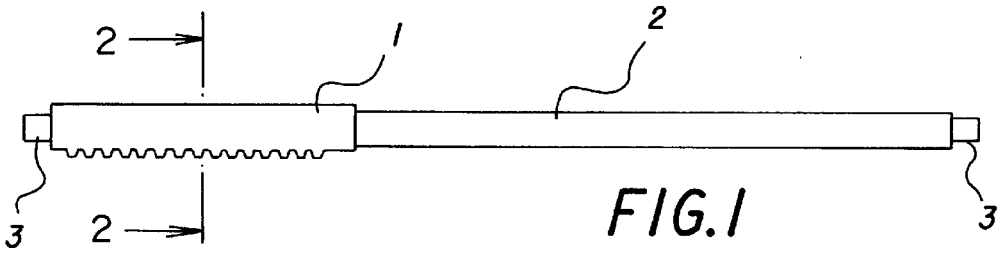
FIG. 1 is a rack bar made by a die according to the invention.

FIG. 1 shows a typical Y-form rack bar made according to an embodiment of the invention comprising toothed portion 1 and cylindrical portion 2. Usually the ends 3 of the rack bar are threaded for the attachment of ball joints and tie rods. In another lesser used type, tie rods are fastened to the rack bar by rubber bushed studs located near the vehicle longitudinal centre line, for which purpose the cylindrical rack bar may be made locally enlarged, drilled and tapped. The method to be described also applies to the manufacture of these "centre-take-off" rack bars and to other types of racks having alternate cross-sectional shapes by suitably shaping the forming faces of the respective die elements.

Figure 2:
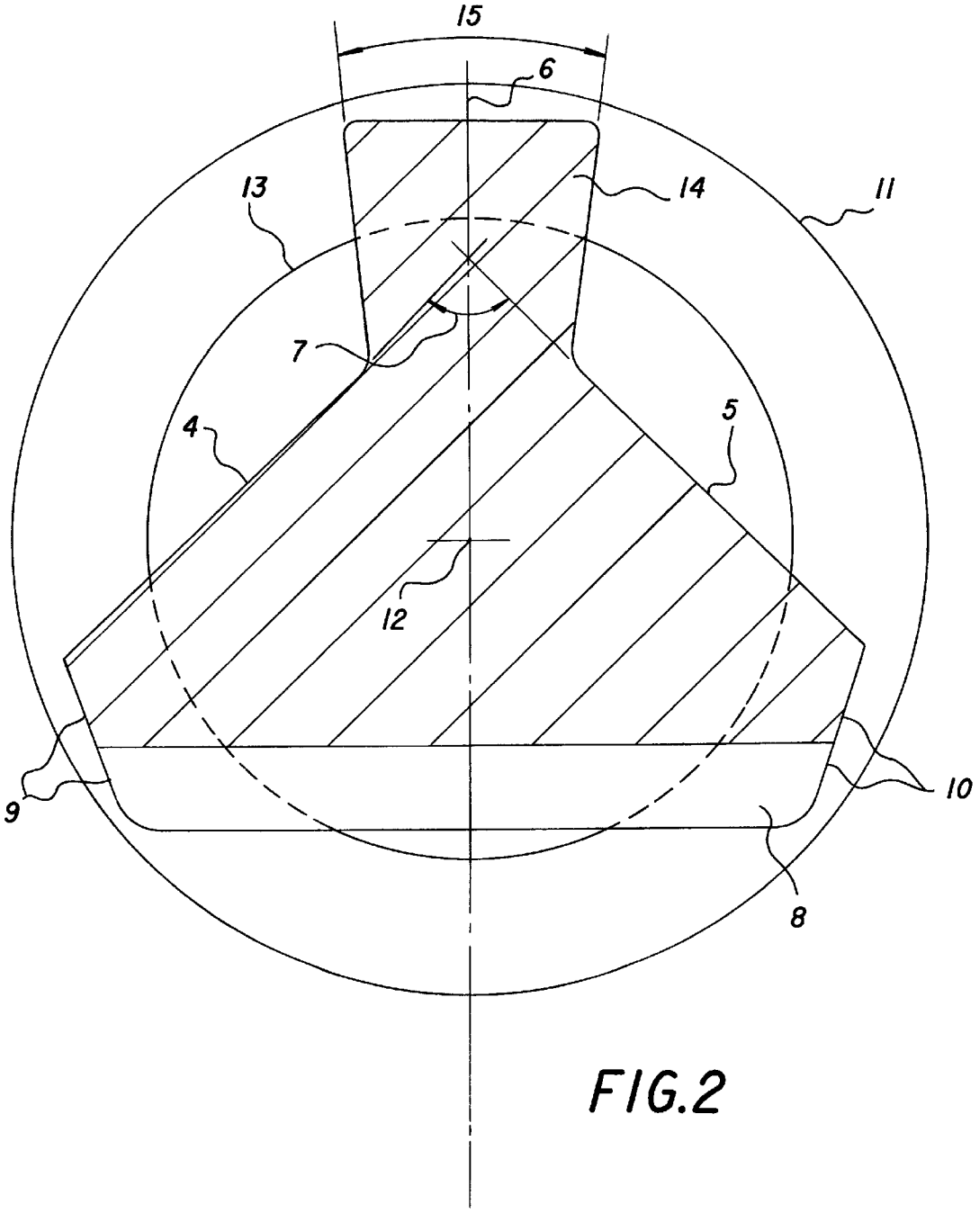
FIG. 2 is a cross sectional view of the rack bar on plane A—A of FIG. 1.

FIG. 2 shows the appearance in section of the Y-form rack portion of the rack bar. Circle 13 indicates the cylindrical portion 2 of the rack bar in this view. Opposing guide faces 4 and 5 are symmetrically disposed about vertical axis 6 at an included angle 7 of, say, 90°. Teeth 8 terminate in oblique end faces 9 and 10 in order to make optimum use of the cross-sectional space available on the inside of the steering housing tube indicated by circle 11, centred at 12. Such oblique end faces of the teeth also serve to reduce the change of breakage of the teeth at their outer extremity. Cylindrical portion 2 is also centred at 12. The diameter of the cylindrical portion 2 is chosen so that its cross-sectional area is substantially identical to the mean cross-sectional area of the toothed portion 1. Stem 14 of the Y-form has a slight taper to its opposing flanks as indicated by angle 15 providing a dovetail shape.

Figure 3:
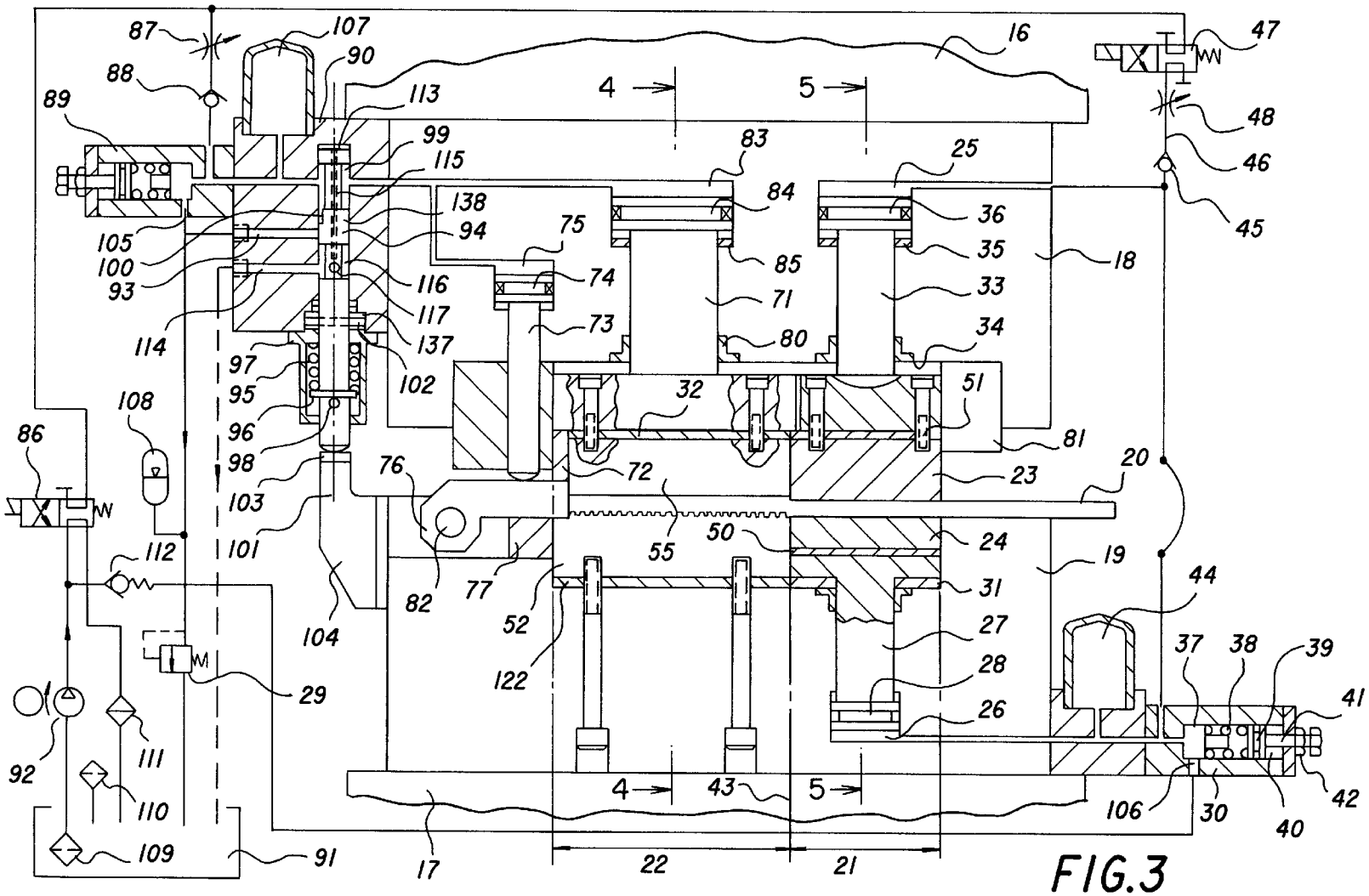
FIG. 3 is a sectional elevation of a die according to the invention.
Figure 4:
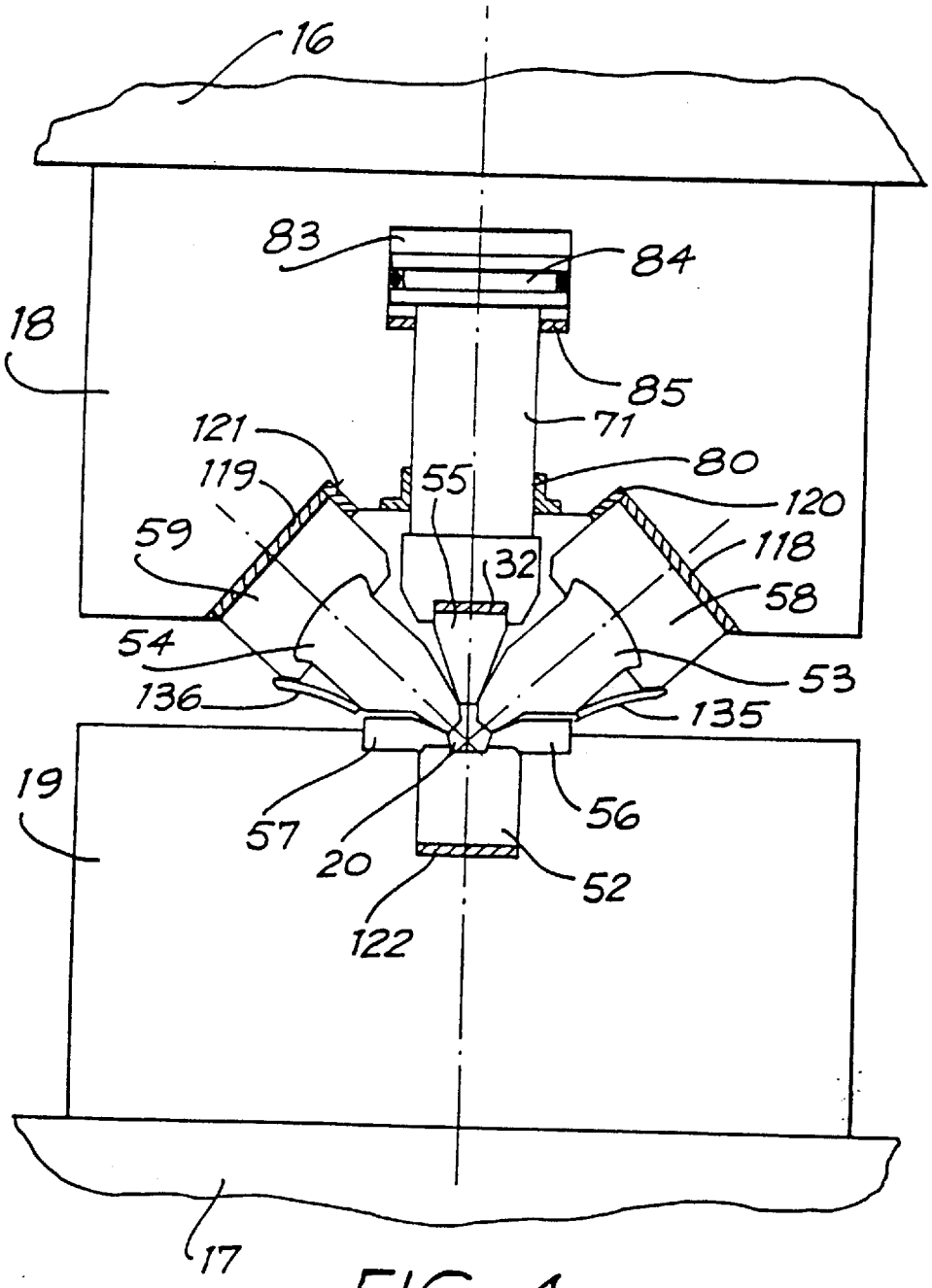
FIG. 4 is a sectional view of the die on plane C—C of FIG. 3.
Figure 5:
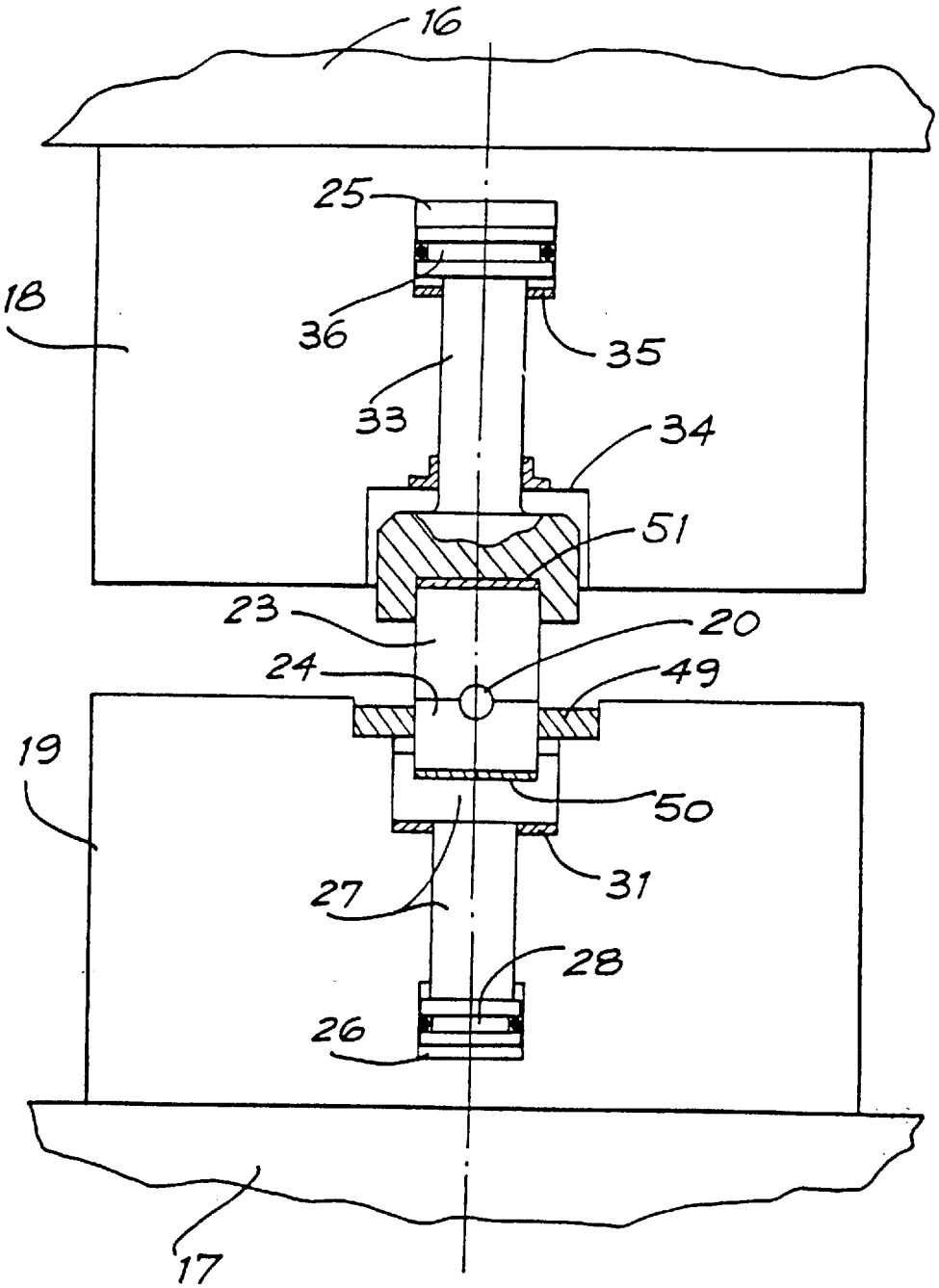
FIG. 5 is a sectional view of the die on plane D—D of FIG. 3.

FIGS. 3, 4 and 5 show an embodiment of the die according to the present invention for making racks of the type described, as installed in a press (not shown), having moveable platen 16 and fixed lower platen 17.

The die comprises upper die member 18 and lower die member 19 secured to respective upper and lower platens 16 and 17 of the press and, in each of the three views depicted in FIGS. 3, 4 and 5, is shown in the fully closed position as when rack bar 20 has been fully formed. The die has two zones along the length of the rack bar, a gripping zone 21 and a forming zone 22 (FIG. 3).

As upper die member 18 descends, the several elements of gripping zone 21, a section of which is shown in FIG. 5, first engages rack bar blank 20 after which the several elements of forming zone 22 shown in FIG. 4 form the entire rack portion of the rack bar in one blow.

Gripping zone 21 comprises an upper gripper 23 and a lower gripper 24 each having semi-circular grooves engaging rack bar blank 20 and loaded respectively by hydraulic cylinders 25 and 26.

Lower gripper 24 is secured to plunger 27 which is urged upward by piston 28 which is subjected to supply oil pressure (typically 2 to 3.5 MPa) prior to upper gripper 23 coming into contact with rack bar blank 20. The level of supply oil pressure is set by relief valve 29 when the die is open and by relief valve 30 during gripping. Downward movement of lower gripper 24 is limited by contact of plunger 27 with spacer 31, and upward movement is limited by contact between plunger 27 and keeper 49 (see FIGS. 3 and 5).

Upper gripper 23 is secured to plunger 33 which is urged downward by piston 36 which is subjected to supply oil pressure prior to upper gripper 23 coming into contact with rack bar blank 20. Upward movement of upper gripper 23 is limited by contact of plunger 33 with abutment 34, and downward movement is limited by contact between piston 36 and spacer 35.

Spacer 31 provides a means of adjusting the stroke of lower gripper 24, and hence the degree of offset produced in the rack bar in plane 43, to suit different designs of rack bars. Keeper 49 controls the initial position of lower gripper 24 relative to lower toothed die 52. Spacer 35 provides a means of adjusting the stroke of upper gripper 23 to suit different rack bar designs. Adjustable packer 51 and 50 provide a means of compensating for the reduction in vertical dimensions of grippers 23 and 24 respectively after refurbishment.

When upper gripper 23 comes into contact with rack bar blank 20 during die closure, the pressure in hydraulic cylinders 25 and 26, which are interconnected as shown in FIG. 3, increases beyond supply pressure by virtue of the downward displacement of piston 28, which is smaller in area than piston 36. The oil displaced by piston 28 is discharged through relief valve 30 via port 106 by displacement of flapper 37 against spring 38. The pressure at which relief valve 30 discharges, and hence the magnitude of the gripping forces developed by upper gripper 23 and lower gripper 24, is set by adjusting the pre-load force in spring 38 by displacing plunger 39 in bore 40 of relief valve 30 by screw 41, which is locked in place by lock nut 42.

Prior to full die closure being reached, bottom gripper 24 bottoms out when plunger 27 comes in contact with spacer 31. At this point in the forming cycle, piston 36 commences its displacement upward relative to upper die member 18. The oil displaced by motion of piston 36 is also discharged through relief valve 30.

The areas of pistons 28 and 36 are chosen such that, with the same pressure acting on these pistons, the force exerted by piston 36 will be sufficient to overcome the sum of the force exerted by piston 28 and the force required to shear the offset into rack bar blank 20 in plane 43.

Because of the extremely short response time required of relief valve 30 (typically 7 ms to fully open), a pilot operated relief valve can not be used in this application, and relief valve 30 must be of the direct acting type. It is well known in the art that direct acting relief valves are potentially subject to instability and are particularly sensitive to the rate of change of pressure. Accumulator 44 is therefore provided to limit the rate of pressure rise imposed on relief valve 30 to an acceptable limit, typically 1400 MPa/s.

During die closure, oil displaced from cylinders 25 and 26 is prevented from flowing into supply line 46 by check valve 45. At the instant die closure is initiated, solenoid valve 47 closes to flow and remains closed until after the die has opened and the formed rack has been ejected by a means that will be described hereafter. When solenoid valve 47 is opened to flow, the rate at which oil is re-admitted to cylinders 25 and 26 is controlled by adjustable throttle valve 48.

Considering now a cross section of forming zone 22 (FIG. 4), it will be seen that in the fully closed position the rack is contained by four die forming elements: a first forming element in the form of lower toothed die 52, second and third forming elements in the form of rolling dies 53 and 54 and a fourth forming element in the form of the upper die element 55. Flank dies 56 and 57 may be made in one part with lower toothed die 52 but are here shown as being made separately for convenience of manufacture and servicing. Rolling dies 53 and 54 are supported by fulcrum blocks 58 and 59 which are secured to upper die member 18.

The upper die element 55 and upper gripper 23 are mechanically separated (see FIG. 3), and in this embodiment where these components are hydraulically actuated by respective plunger/cylinder arrangements, they are not only separated but are also independently controlled.

The kinematic operation of forming elements 52–57 is fully described in U.S. Pat. No. 4,571,982. An important difference between the present invention and U.S. Pat. No. 4,571,982 in relation to the operation of these various elements is that the control of the forming force exerted by upper die element 55 on rack bar 20 is achieved by hydraulic means rather than by a mechanical spring or springs. This enables the timing, magnitude and characteristic (non-linear vs linear) of the forming force exerted by upper die element 55 to be readily varied, enabling it to be rapidly and conveniently fine-tuned to suit different designs of rack bars.

As upper die member 18 descends, rack bar 20 is firstly gripped by upper gripper 23 and lower gripper 24, as described earlier. On further descent of upper die member 18, rolling dies 53 and 54 come into contact with rack bar 20 which is in contact with the top of lower toothed die 52. At this point in the cycle, upper die element 55 may not be in contact with rack bar 20, depending on the design of the Y-form cross-section, the rack teeth, and the degree of offset required between the cylindrical portion and the toothed section of the finished rack bar.

Figure 8:
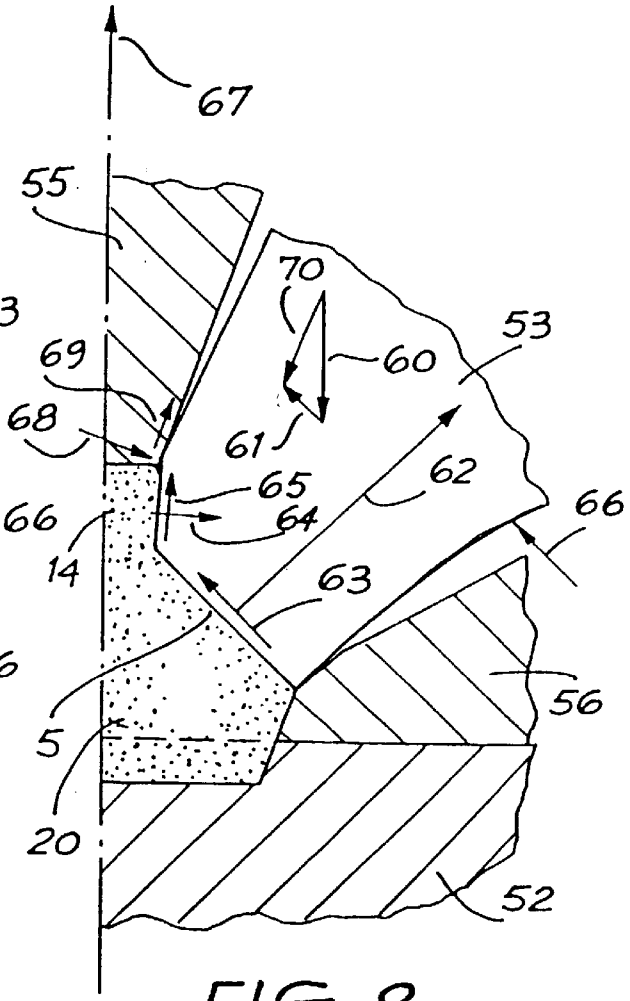
FIGS. 6, 7 & 8 show various stages of forming the rack bar Y-form and teeth.
Figure 7:
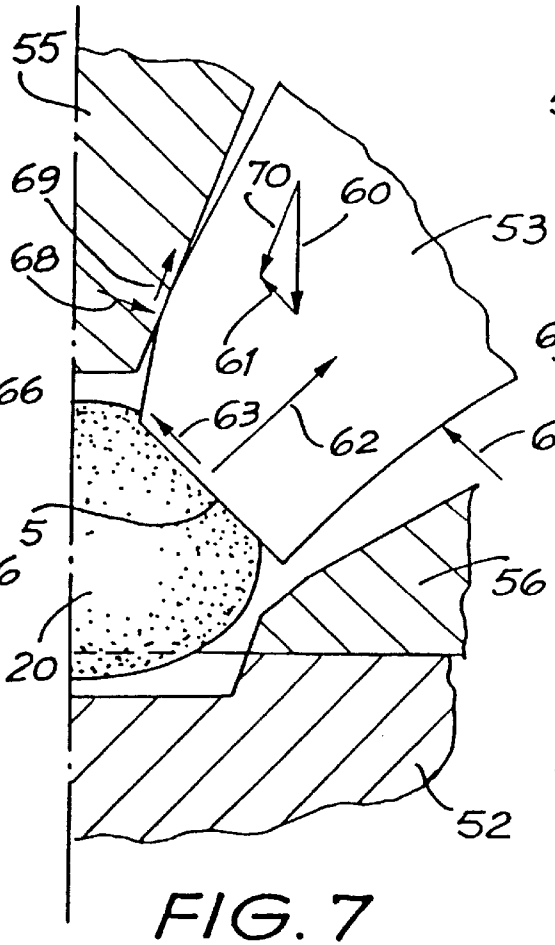
Figure 6:
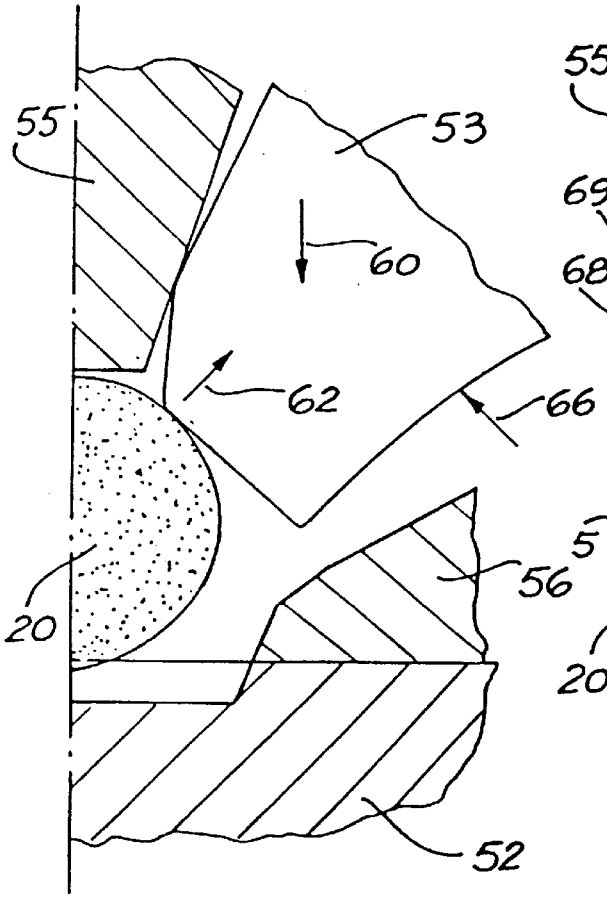

FIGS. 6, 7 and 8 are scrap views illustrating the forming of the Y-form portion of the rack, with only one half shown because of symmetry.

FIG. 6 shows the relative positions of lower toothed die 52, rack bar 20, rolling die 53 and upper die element 55 at the instant lower gripper 24 bottoms out. At this point in the forming cycle, further descent of upper die element 55 relative to lower toothed die 52 is arrested by contact of plunger 71 with stop block 72 and upper gripper 23 (see FIG. 3).

On further descent of upper die member 18, rolling die 53 moves downward relative to lower toothed die 52 with velocity 60, and develops a rolling motion, illustrated by velocity component 61, about its instantaneous centre with fulcrum block 58 (not shown). The resulting motion of rolling die 53 is controlled by a complex force system comprised of normal forging forces 62 and 64; frictional forging forces 63 and 65; normal and frictional forces 68 and 69 respectively; spring force 66 exerted by plate spring 135 (see FIG. 4); and normal forging force 67 acting on upper die element 55. The geometry of rolling dies 53 and 54; fulcrum blocks 58 and 59; and upper die element 55 is chosen to produce a force system which biases the motion of rolling dies 53 and 54 so as to cause light contact (small values of forces 68 and 69) with upper die element 55. Resultant velocity vector 70 represents the velocity of rolling die 53 at the point of contact with upper die element 55, and is substantially parallel to the side flank of upper die element 55 throughout the forming process.

Other elements shown in FIG. 4 are spacers 118, 119, 120 and 121 which are ground to size to suit each different design of rack bar to be formed. These spacers allow the geometry of the motion of rolling dies 53 and 54 to be varied within limits by changing their instantaneous centres of motion between fulcrum blocks 58 and 59 respectively, and to compensate for elastic deflections in tooling and the upper and lower die members. Spacers 122 and 32 are provided to compensate for the changed vertical dimensions of toothed die 52 and upper die element 55 after refurbishment.

The operation of forming zone 22 is further described hereunder. On descent of upper die member 18, plunger 73 which is extended by the action of supply oil pressure acting on piston 74 by cylinder 75, comes into contact with end stop 76, clamping it down against stop block 77. This action takes place just prior to first contact between grippers 23 and 24 and rack bar 20. End stop 76, which is pivoted about axis 82, is held in this position throughout the forming process, and prevents extrusion of metal longitudinally from the forging zone. Longitudinal extrusion of metal from the opposite end of the forming zone is prevented by the clamping action of grippers 23 and 24.

As upper die member 18 continues its descent, plunger 73 is displaced upward relative to upper die member 18, causing oil to be displaced from cylinder 75 by piston 74. This displaced oil cannot flow into cylinder 83 which has previously been fully extended (piston 84 displaced downward until it contacts spacer 85) by the action of supply oil pressure admitted via solenoid valve 86, adjustable throttle valve 87 and check valve 88. The displaced oil is further prevented from flowing to tank 91 by relief valve 89 or to pump 92 by check valve 88. Displaced oil is therefore first discharged via port 93 of spool valve 138 to relief valve 29. Note that valve spool 94 is shown in the fully displaced position in FIGS. 3 and 10(*c*). Initially, valve spool 94 is displaced fully downward (see FIGS. 3 and 10(*a*)) by spring 95 acting between collar 96 and housing 97. FIG. 10(*b*) shows valve spool 94 part way through its stroke. Collar 96 acts against pin 98 which transmits its load to valve spool 94. When valve spool 94 is in the fully down position, port 93 is open to flow from chamber 99.

Hence, the initial pressure imposed on cylinders 75 and 83, when piston 74 is displaced, is the system pressure set by relief valve 29 (typically 2 to 3.5 MPa).

As upper die member 18 continues to descend, valve spool 94 is displaced upward relative to spool valve manifold 90, progressively closing off port 93 to chamber 99. The area characteristic of the spool valve may be varied by changing the angular orientation of flat 100 machined in the side of cylindrical valve spool 94, with respect to port 93. This is achieved by rotating cylindrical housing 97 about axis 101. Pin 102 in valve spool 94 engages slot 137 in housing 97 and connects housing 97 with valve spool 94, hence rotation of housing 97 imparts the same rotation to valve spool 94. In this way, all or part of flat 100 may be presented to port 93, thus providing the desired variable area characteristic for the spool valve. FIGS. 10(*d*), 10(*e*) and 10(*f*), which are sectional views in plane E—E of FIGS. 10(*a*), 10(*b*), and 10(*c*), show in plan view different angular orientations of flat 100 with respect to port 93.

Valve spool 94 is displaced upward by contact with spacer 103, which is connected to lower die member 19 by striker 104, during die closure. By varying the thickness of spacer 103, the process of varying the pressure in cylinders 75 and 83 as the die closes can be initiated at different stages of the forming cycle, as dictated by rack bar designs. The rate at which pressure increases during die closure is varied by changing the orientation of flat 100 relative to port 93, as earlier described.

At a certain point in the forming cycle, typically 2 to 3 mm before full die closure is reached, valve spool 94 fully closes off port 93 to flow. Any further oil displaced must be discharged via relief valve 89, which is similar in construction and principle of operation to that of relief valve 30 earlier described. Once the discharge pressure set by relief valve 89 is reached, oil is discharged via port 105 to relief valve 29 and thence to tank 91. Accumulator 107 is provided, as is the case of accumulator 44, to limit the rate of pressure rise to an acceptable level.

Accumulator 108, of the pre-charged gas-bladder type, is provided to accommodate the large instantaneous flow rate discharged via port 93 (typically 600 l/min). Accumulators 44 and 107 are without entrained gases or bladder separation and rely on the compressibility effects of the oil to be used to limit the rate of pressure rise imposed on relief valves 30 and 89 respectively.

Oil displaced from cylinder 113 by upward motion of valve spool 94 is discharged via drillings 115 and 117 into chamber 116 and thence to drain via port 114.

Other hydraulic elements shown in FIG. 3 include suction strainer 109, oil tank breather 110, oil cooler 111 and relief check 112. Relief check 112 is provided to create a flow path in the unlikely event that solenoid valve 86 is open to flow, all cylinders are fully extended and valve spool 94 is in its uppermost position (eg: die closed during set-up, or valve spool jammed), thereby shutting off flow from port 93. Without relief check 112, pump 92 would stall and rapidly overheat. In the normal course of events, relief check 112 is unnecessary.

The final die pressure achieved, and hence the degree of fullness of form and tooth quality generally imparted to the rack bar by lower toothed die 52 is critically dependent on the maximum value of force 67 achieved (see FIG. 8). In current production dies built according to U.S. Pat. No. 4,571,982 this force is controlled by mechanical springs as earlier described. For practical reasons, beam springs have been used (high energy stored per unit volume) and because of the relatively short working stroke (typically 2 to 4 mm) and high final load (typically 50 to 60 tonnes for each of two identical springs) these springs are highly pre-loaded. Although beneficial from the point of view of fatigue life of such springs, this high pre-load is not needed on upper die element 55 which develops its full force 67 only in the last 1 to 2 mm of die closure, but is highly desirable from the point of view of operation of the grippers 23 and 24 which must develop large gripping force very early in the forging cycle. It is basically this incompatibility between the requirements of the gripping zone 21 of the die (large gripping force established as soon as possible after initial contact) and the forming zone 22 (relatively low initial forces required of upper die element 55 and plunger 73), together with the inability to readily vary initial, final and rate of change of forces acting on forming elements in gripping and forming zones 21 and 22 respectively in the prior art Y-die, which the embodiment of the present invention overcomes.

The essential differences between force and cylinder pressure characteristics required of hydraulic elements in gripping and forming zones 21 and 22 respectively will now be qualitatively described by reference to FIGS. 9(*a*) through 9(*e*) inclusive.

Figure 9:
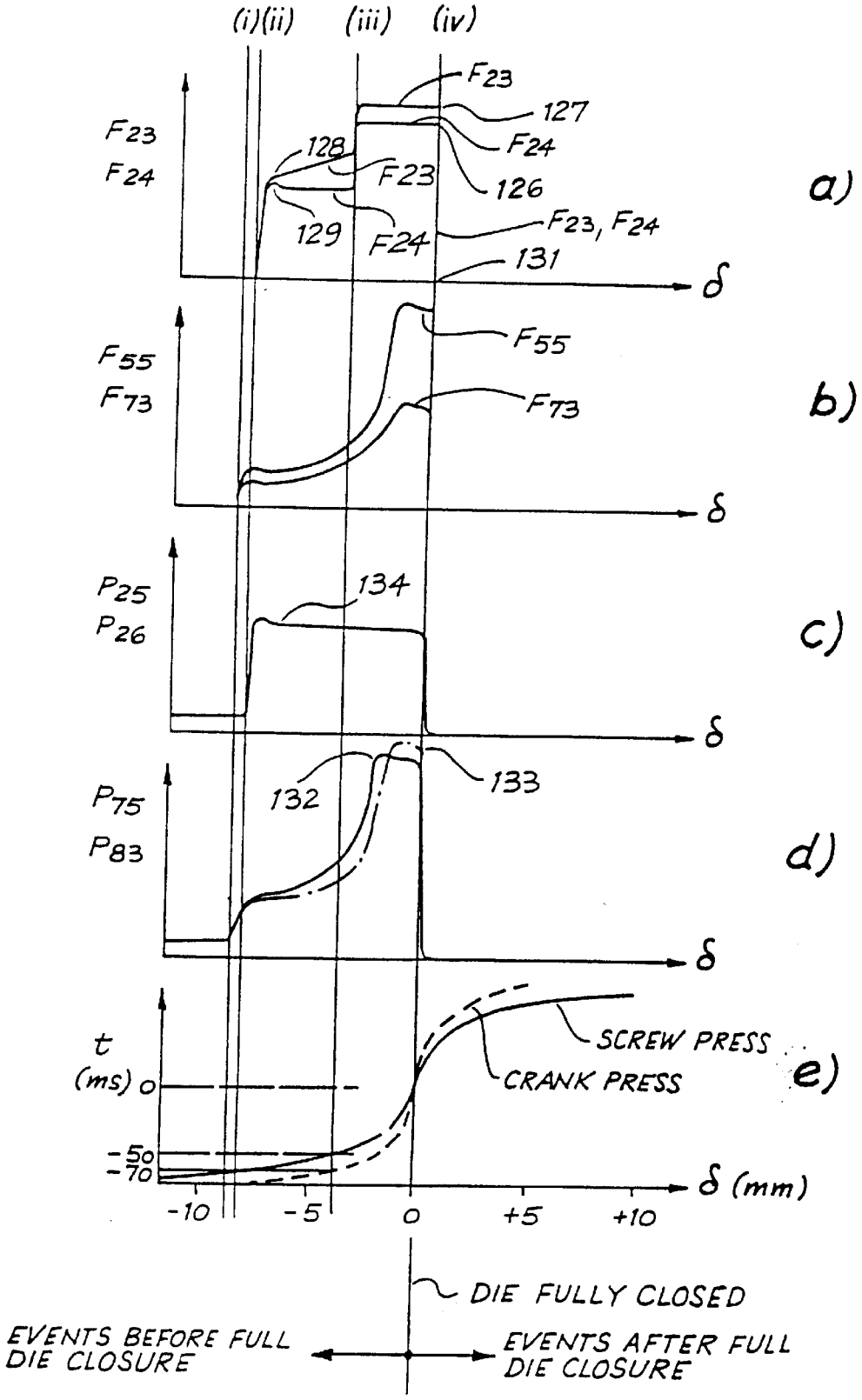
FIG. 9 shows the relationship between forces and pressures on die elements as a function of die opening dimension.
Figure 10C:
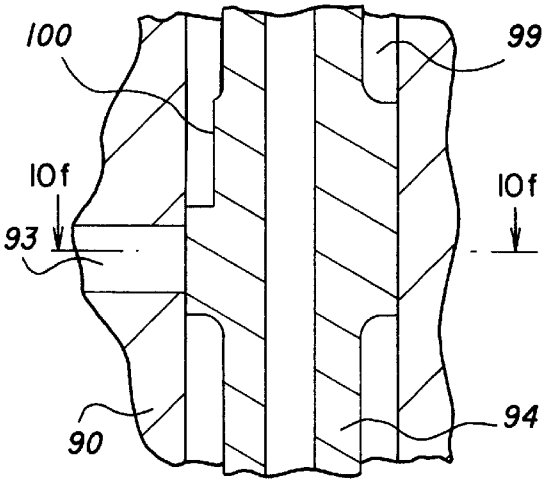
FIGS. 10*a–c* are enlarged elevation sectional views showing details of the valve spool of FIG. 3. in three different axial and rotational positions.
Figure 10B:
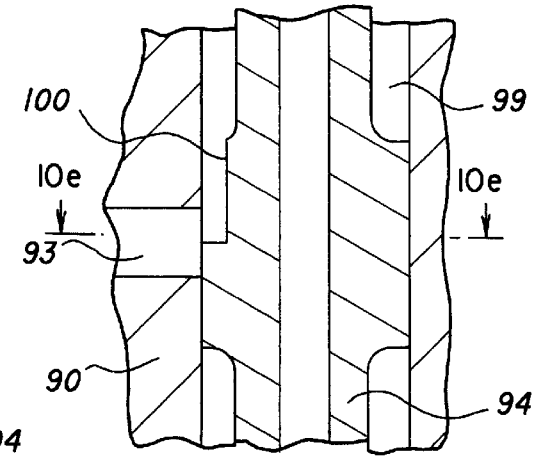
Figure 10A:
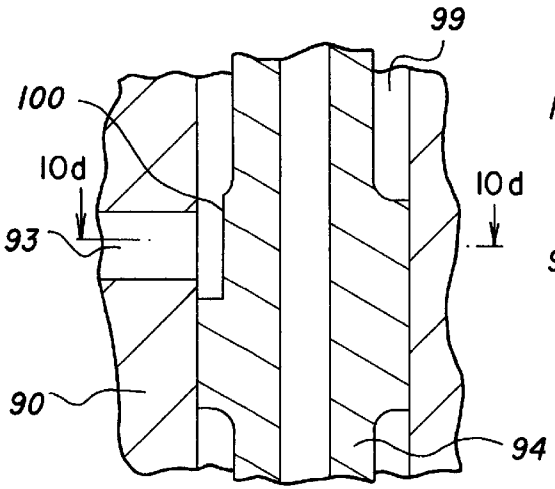
Figure 10F:
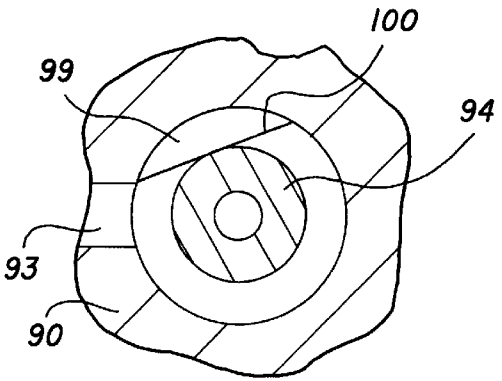
FIGS. 10*d–f* are corresponding sectional views of the spool on plan E—E of FIGS. 10*a–c*
Figure 10E:
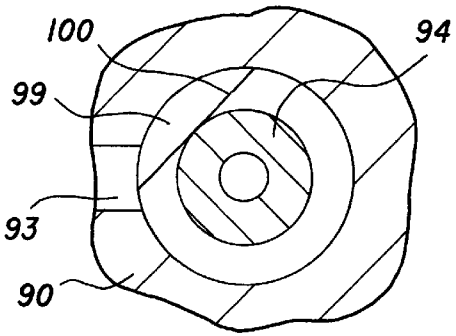
Figure 10D:
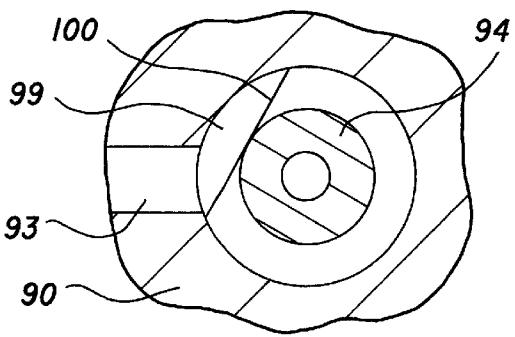

The abscissae in FIGS. 9(*a*) through 9(*e*) represent in each case the opening δ between upper die member 18 and lower die member 19. A value of δ=0 indicates the die is fully closed, as shown in FIGS. 3, 4 and 5. A value of δ=−10 indicates upper die member 18 has 10 mm of travel left before reaching the fully closed state, whilst a value δ=+10 indicates that upper die member 18 has opened by 10 mm following the fully closed state.

In FIGS. 9(*a*) to 9(*e*), events (i) to (iv) are defined as follows:

(i) denotes the instant of contact between plunger 73 and end stop 76;

(ii) denotes the instant of first contact between upper gripper 23 and rack bar blank 20;

(iii) denotes the instant bottom gripper 24 bottoms out against spacer 31; and (iv) denotes the instant of full die closure (δ=0).

Forces $F_{23}$ and $F_{24}$ in FIG. 9(*a*) are those forces exerted on rack bar 20 by upper gripper 23 and lower gripper 24 respectively. Force $F_{55}$ in FIG. 9(*b*) is that exerted on rack bar 20 by upper die element 55, and Force $F_{73}$ is that exerted on end stop 76 by plunger 73. Pressures $P_{25}$ and $P_{26}$ in FIG. 9(*c*) denote pressures developed in cylinders 25 and 26 respectively. Pressures $P_{75}$ and $P_{83}$ in FIG. 9(*d*) denote pressures developed in cylinders 75 and 83 respectively. 't' denotes time in FIG. 9(*e*).

At the instant of first contact (ii) between upper gripper 23 and rack bar 20, the forces $F_{23}$ and $F_{24}$ exerted on upper gripper 23 and lower gripper 24 respectively increase rapidly to values indicated by points 128 and 129 respectively. The values of forces $F_{23}$ and $F_{24}$ achieved at these points are determined by the setting of relief valve 30, and the rate of rise of pressure in cylinders 25 and 26 is determined by the volume of oil in and the elastic properties of accumulator 44.

The additional force required to shear the offset into the bar in plane 43 is illustrated by the difference between forces $F_{23}$ and $F_{24}$ between points 128, 129, 127 and 126. At instant (iii), bottom gripper 23 bottoms out against spacer 31 and gripping forces $F_{23}$ and $F_{24}$ increase as shown in FIG. 9(*a*). The difference between forces $F_{23}$ and $F_{24}$ remains substantially constant between instant (iii) and the instant (iv) of maximum die closure (δ=0). Although pressures $P_{25}$ and $P_{26}$ remain equal and constant after instant (iii), gripping forces $F_{23}$ and $F_{24}$ increase because piston 36, which is larger in area than piston 28, commences its displacement relative to upper die member 18 at instant (iii). Prior to instant (iii), the force of pressure $P_{25}$ acting on piston 36 is reacted partly by spacer 35 and partly by upper gripper 23. After instant (iii), the full value of the force of pressure $P_{25}$ acting on piston 36 is transferred to upper gripper 23, hence the increase in gripping forces $F_{23}$ and $F_{24}$.

The difference between gripping forces $F_{23}$ and $F_{24}$ between instants (iii) and (iv) is the shear force in rack bar 20 in plane 43, and the increased value of bottom gripper force $F_{24}$, is reacted partly by spacer 31 and partly by the force of pressure $P_{26}$ acting on piston 28.

Note that the values of force $F_{23}$ and $F_{24}$ may be easily varied according to the present invention by adjusting relief valve 30 to the requisite value to prevent extrusion of metal from forming zone 21 through grippers 23 and 24.

At the instant of die opening (δ>0), gripping forces $F_{23}$ and $F_{24}$ reduce immediately to zero (point 131). The formed rack bar 20 is then extracted from tooth die 52 by the clamping action of rolling dies 53 and 54 on stem 14 of the Y-form. This clamping action arises from the forces 66 exerted by spring-steel plated springs 135 and 136 on rolling dies 53 and 54 respectively.

Note that forces $F_{55}$ and $F_{73}$ and cylinder pressures $P_{25}$, $P_{26}$, $P_{75}$, and $P_{83}$ all reduce rapidly to zero immediately after the instant of die opening (δ>0). This means there is no tendency to eject the formed rack bar 20 from between rolling dies 53 and 54, and rack bar 20 will remain clamped between rolling dies 53 and 54 until supply oil pressure is re-admitted to cylinder 83 by solenoid valve 86. Activation of solenoid valve 86 may be either by a push-button actuated by the operator in a manual loaded die, or may be actuated automatically by the control system in a die incorporating a fully automatic loading system.

Following a forging blow (δ>0), solenoid valve 47 remains closed to flow until after solenoid valve 86 has opened to flow and rack bar 20 has been ejected by upper die element 55. Thereafter, solenoid valve 47 is opened to flow, cylinders 25 and 26 extend upper and lower grippers 23 and 24 respectively by applying supply oil pressure to pistons 36 and 28 respectively. The rate at which grippers 23 and 24 are extended is set by adjustable throttle valve 48.

The fact that gripping forces $F_{23}$ and $F_{24}$ reduce to zero immediately after forming, ensures that the straightness of rack bars 20 produced in this die is greatly improved over that of the prior art die.

FIGS. 9(*e*) and 9(*d*) illustrate the essential difference between the pressure characteristics required of elements in gripping zone 21 and forming zone 22 respectively.

FIG. 9(*d*) shows that $P_{75}$ and $P_{83}$ start to increase at instant (i). As described earlier, piston 74 is the first piston displaced in the forming cycle. It is not necessary to develop full clamping force on end stop 76 until the last 2–3 mm of die closure, hence the rate of pressure increase in the early stages of die closure is initially high, due to the step change in oil flow velocity but limited by compression of the oil in accumulator 107, then low as relatively unrestricted flow of oil through port 93 is established, and still later exponentially increasing until the pressure indicated by point 132 is reached, at which point port 93 is fully closed to flow by valve spool 94, and relief valve 89 opens. The chain dotted line in FIG. 9(*d*) illustrates an alternative combination of rate of rise of pressure and relief valve set point pressure, curve 133, is easily varied without having to remove the die from service or machine any components. Forces $F_{55}$ and $F_{73}$ in FIG. 9(*b*) correspond to pressures $P_{83}$ and $P_{75}$ respectively in FIG. 9(*d*). Clamping force $F_{73}$ is smaller because the area of piston 74 is made smaller than that of piston 84. Typically, the peak design pressures in cylinders 75 and 83 are in the range 32 to 42 MPa, with forces 10 to 14 tonnes and 80 to 110 tonnes respectively.

By contrast, pressures $P_{25}$ and $P_{26}$, which begin to increase at instant (ii), must increase rapidly to the maximum value indicated by point 134 in FIG. 9(*c*) in order to firmly clamp rack bar 20 prior to shearing the offset in plane 43 and commencing substantial forming of the Y-form portion. The rate of pressure rise, as described earlier, is limited by accumulator 44, and relief valve 30 limits the operating pressures $P_{25}$ and $P_{26}$ acting on pistons 36 and 28 respectively.

Finally, FIG. 9(*e*) shows two typical time displacement curves for a die according to the present invention. The typical values for a screw press and crank press are illustrated by the solid curve and dashed curves respectively. Note that the contact time between rack bar and forming elements is shorter for screw presses, which can be of benefit for high volume production applications, but provided the longer contact time arising from use of a crank press does not lead to any significant reduction in tool life, a crank press can be used.

It will be recognised by persons skilled in the art that numerous variations and modifications may be made to the invention as described herein without departing from the spirit or scope of the inventions as defined in the succeeding claims.

We claim:

1. A die for forming a toothed portion of a steering rack bar from a blank by forging, the toothed portion having a face with teeth and at least two longitudinally extending guide faces, the die comprising first and second die members and a group of first, second, third and fourth forming elements relatively moveable to converge on the blank when placed in the die, the first forming element being part of the second die member and having a form on one face corresponding to the obverse form of the teeth, the second and third forming elements being part of the first die member and having forming faces adapted to form the longitudinally extending guide faces of the toothed portion, the fourth forming element connected to a first bias means and slidable relative to the first die member between the second and third forming elements and adapted to form a surface of the toothed portion lying between the guide faces and opposite the teeth, the first bias means allowing movement of the fourth forming element away from the blank under loads imposed during forging, the die further comprising a gripper system for longitudinally constraining the blank during forging, the gripper system comprising opposed first and second grippers loaded radially against a non-formed surface of the blank during forging, the first gripper connected to a second bias means and slidable relative to the first die member and the second gripper connected to a third bias means and slidable relative to the second die member, wherein gripping loads exerted within said gripper system are independently controlled from that of forging loads imposed by said fourth forming element and first bias means.

2. A die as claimed in claim 1 wherein the first bias means and the second bias means are hydraulic actuators.

3. A die as claimed in claim 1 wherein the third bias means is a hydraulic actuator.

4. A die as claimed in claim 1 wherein the second and third bias means are hydraulic actuators and are hydraulically interconnected.

5. A die as claimed in claim 1 wherein at least two of the first, second and third bias means are hydraulic actuators and the magnitude and instant of application of the pressure in at least one hydraulic actuator is separately controlled.

6. A die as claimed in claim 1 wherein the die further comprises a restraint means for longitudinally restraining the blank during forging, the restraint means pivotally mounted about an axis substantially perpendicular to the longitudinal axis of the blank and having a face substantially perpendicular to the longitudinal axis of the blank, the restraint means clamped by a clamp means against a fixed stop portion of the second die member during closure of the die.

7. A die as claimed in claim 1 wherein at least one of the first, second or third bias means is a hydraulic actuator in which the pressure applied thereto is controlled as a function of the relative displacement of the first and second die members.

8. A die as claimed in claim 1, wherein at least one of the first, second and third bias means is a hydraulic actuator controlled by at least one pressure relief valve.

9. A die as claimed in claim 1, wherein at least one of the first, second and third bias means is a hydraulic actuator controlled by at least one pressure relief valve with at least one accumulator connected to the hydraulic connection between the hydraulic actuator and the relief valve.

* * * * *